US006929171B1

(12) United States Patent
Thiersch

(10) Patent No.: US 6,929,171 B1
(45) Date of Patent: Aug. 16, 2005

(54) STACKABLE FOLDING CONTAINERS WITH POURING DEVICES

(75) Inventor: Georg Thiersch, Munich (DE)

(73) Assignee: SIG Combibloc Systems GmbH, Linnich (DE)

( * ) Notice: Subject to any disclaimer, the term of this patent is extended or adjusted under 35 U.S.C. 154(b) by 0 days.

(21) Appl. No.: 10/129,898

(22) PCT Filed: Sep. 29, 2000

(86) PCT No.: PCT/EP00/09571

§ 371 (c)(1),
(2), (4) Date: Oct. 24, 2002

(87) PCT Pub. No.: WO01/23260

PCT Pub. Date: Apr. 5, 2001

(30) Foreign Application Priority Data

Sep. 30, 1999 (DE) ..... 199 47 014
Apr. 11, 2000 (DE) ..... 100 17 735

(51) Int. Cl.[7] ..... B65D 5/46

(52) U.S. Cl. ..... 229/125.15; 229/108; 229/215; 229/269

(58) Field of Search ..... 229/108, 116.1, 229/114, 214, 215, 249, 124, 125.04, 125.01, 229/125.14, 116.4, 125.5

(56) References Cited

U.S. PATENT DOCUMENTS 3,762,625 A * 10/1973 Mojonnier ..... 229/123.1
4,498,585 A * 2/1985 Gordon et al. ..... 206/518
4,813,578 A * 3/1989 Gordon et al. ..... 222/541.1
5,069,385 A 12/1991 Färber
5,076,493 A * 12/1991 Anderson ..... 229/125.15
5,114,069 A 5/1992 Detzel et al.
5,738,272 A * 4/1998 Anchor et al. ..... 229/109
6,182,887 B1 * 2/2001 Ljunstrom et al. ..... 229/112

FOREIGN PATENT DOCUMENTS

DE 295 18 869 U1 3/1996

* cited by examiner

*Primary Examiner*—Tri M. Mai
(74) *Attorney, Agent, or Firm*—Proskauer Rose LLP

(57) ABSTRACT

A reclosable container is illustrated and described, having a rectangular base, four lateral surfaces positioned essentially perpendicularly to one another (body surfaces (1, 3)), a head region, sealed using a rib seam (5) after the container is filled, and a closure element (8), positioned on a slanted surface (7) in the head region, in which the container volume can be used optimally without losing the advantages of the known container in regard to production, filling, and sealing. The container is folded in this case so that the slanted surface (7) carrying the closure element (8) at least partially projects out of the rectangular profile predetermined by the base, so that the body surface (1) located below the closure element has a protuberance and the body surface lying opposite the projecting body surface (1) has a corresponding indentation, at least in the head region.

8 Claims, 9 Drawing Sheets

STACKABLE FOLDING CONTAINERS WITH POURING DEVICES

BACKGROUND OF THE INVENTION

The present invention relates to a reclosable container, particularly a cardboard-plastic multilayer composite package for accommodating liquid or paste products, having a rectangular base, four lateral surfaces (body surfaces) positioned essentially perpendicularly to one another, a head region sealed with a rib seam after the package is filled, and a closure element positioned on a slanted surface in the head region.

The field of disposable beverage packaging is currently dominated by the well known right-parallelepiped-shaped cardboard package. Its advantages in regard to cost effective production of the—if necessary—aseptic fillability, distribution, and logistical components in wholesale and retail, as well as very unproblematic storage in the store and with the end-users are clear. In addition to these factors, which can be seen as positive, the multiplicity of the applications of the product should also be emphasized. Thus, for example, the individual product identity is achieved by applying graphical elements, whose variability concerning the design allows multiple different appearances. The cardboard-type containers offer many advantages compared to other disposable beverage packages, such as tubular bag packages, light metal cans, or glass and plastic bottles.

However, a great disadvantage may be determined in regard to the reclosability of this package precisely in relation to the bottle-type containers. The developments of recent years have shown that the importance of reliable reclosability is not to be neglected, since package sizes (family packs) can be increasingly found on the market whose reclosability seems necessary due to the high filling volume. Reclosable cardboard composite containers do, as a rule, have appropriate and well known closure elements, however, they have only been slowly accepted by consumers. This can be primarily attributed to the sometimes impractical and unfamiliar handling of the available closures for cardboard disposable beverage packages, which typically neither allow clean pouring nor satisfactorily solve the requirement of reclosability expected by the consumer (staying sealed while being shaken, etc.).

Many known packages do offer good handling and reclosability, however, they pay for these advantages with unfavorable logistical factors (stackability). Basically, it can be stated that the closure elements projecting from the right-parallelepiped-shaped package must have a certain height so that they are usable with respect to reliable opening and tight reclosure. This overall height leads, however, to problems during stacking and, even after the actual transportation, it happens that individual closure elements are torn off of the packages due to careless handling in the store.

To solve this problem, German Patent Specification 40 15 119 C2 provides that a slanted surface is provided in the head region of the package, on which the closure element is positioned in order to avoid projection of the closure element from the right-parallelepiped-shaped main body. However, this known package is disadvantageous since it requires a relatively large headspace.

SUMMARY OF THE INVENTION

The present invention therefore has the object of implementing and refining the known reclosable container described in more detail above in such a way that the container volume may be used optimally without losing the advantages of the known container in regard to production, filling, and sealing. Furthermore, the blank of such a container and the shape of the package resulting therefrom are to protect the applied closure in the best possible way from force effects and damage. Furthermore, the blank is to be constituted in such a way that consideration is taken of at least the fundamentals of current manufacturing technology.

This object is achieved in that the package is folded so that the slanted surface carrying the closure element projects at least partially from the rectangular profile predetermined by the base, so that the body surface located below the closure element has a protuberance and the body surface lying opposite the projecting body surface has, at least in the head region, a corresponding indentation. According to the present invention, it is ensured that an optimum ratio of filling volume to container volume exists due to the protuberance. By the embodiement according to the present invention, the front side of the package receives a protuberance which would primarily have a negative effect on continuous, and therefore space saving and stable, stackability. In order to counteract this, an indentation, which represents the counterpart of the protuberance described above, is provided in the rear head region of the package by the arrangement of the fold lines according to the present invention. Through the corresponding indentations in the opposite package region, the requirements for good stackability are also fulfilled. It is conceivable in this regard that both the closure element and the slanted surface provided for its attachment are tailored to one another in regard to their dimensions, so that in this way a corresponding protective effect occurs and optimum stackability is possible. In contrast to the changed head region of the package, the design of the bottom remains that of the related art.

According to alternative embodiement of the present invention, the rib seam provided in the head region can be bent over toward the slanted surface or point away from it. However, in any case, unlike the container representing the species according to German Patent Specification 40 15 119 C2, the advantage of the implementation of the rib seam according to the present invention is that it always runs perpendicularly to the slanted surface, so that the "package ears" press against the body surfaces neighboring the body surface having the slanted surface.

According to a further embodiement of the present invention, the protuberance and/or indentation tapers uniformly from the head region toward the bottom region. It is possible at the same time that the fold lines forming the protuberance and/or indentation continue up to the lower package corners, or end at the lower front edge of the body surface having the slanted surface in the region of the package corners.

However, the present invention is also implemented if the protuberance and/or indentation reaches from the head region down to approximately half the container height. It has been shown that this implementation is also completely sufficient to achieve the advantages according to the present invention.

A screw closure is preferably used as a closure element for the reclosable container according to the present invention.

BRIEF DESCRIPTION OF THE DRAWINGS

The present invention is described in more detail in the following with reference to a drawing merely showing preferred exemplary embodiments. In the drawing.

DETAILED DESCRIPTION OF THE INVENTION

Figure 2:
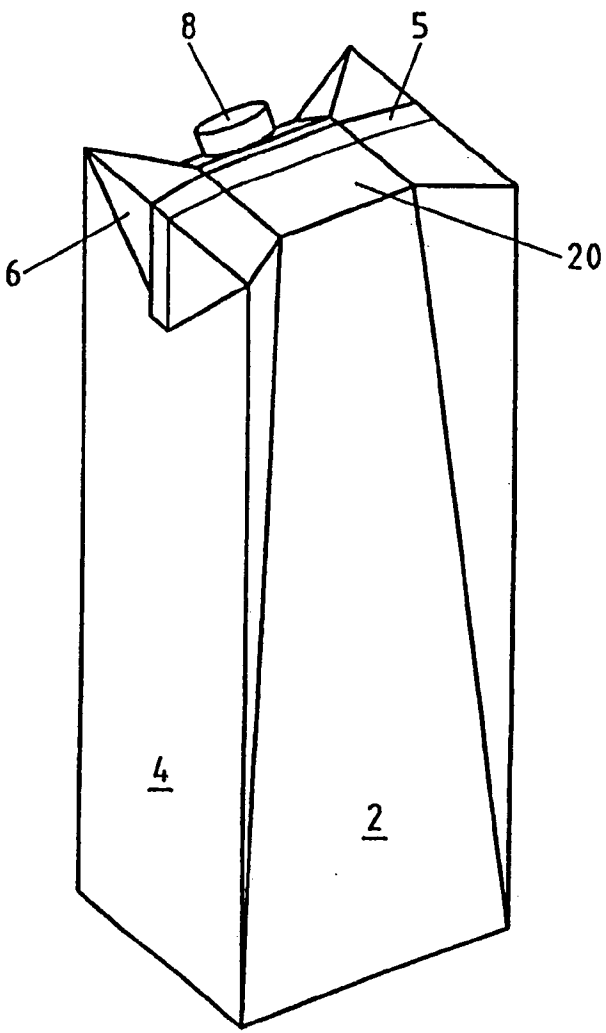
FIG. 2 shows the container from FIG. 1 viewed in perspective from the rear.
Figure 1:
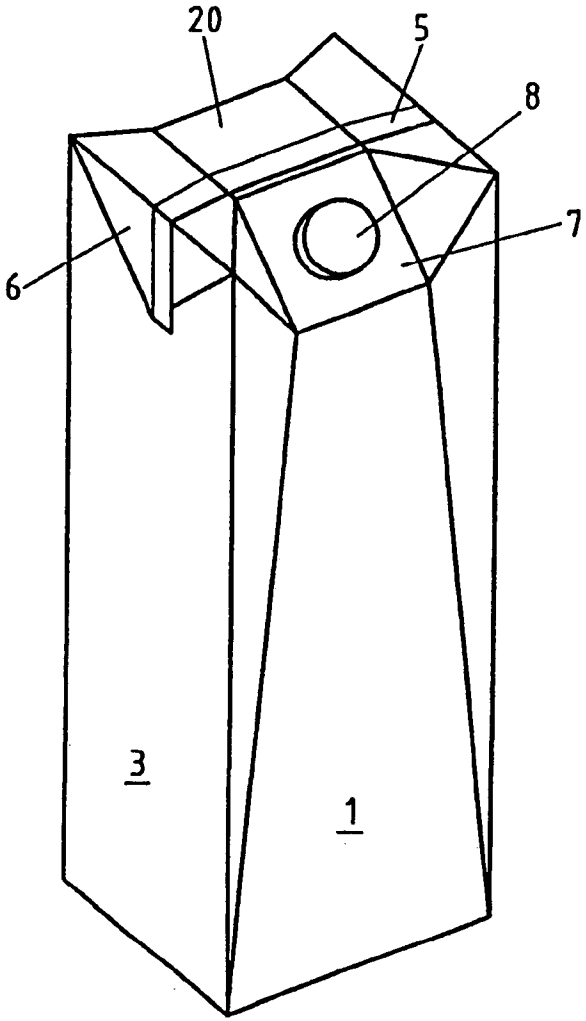
FIG. 1 shows a container according to the present invention in perspective in a first embodiment.

In FIGS. 1 and 2, a first embodiment of a container according to the present invention is illustrated in perspective. In this case, the container has a rectangular base, not shown in more detail, and four lateral surfaces arranged essentially perpendicularly to one another, body surfaces 1, 2, 3, and 4. In the head region, the container is sealed with a rib seam 5, triangular "ears" 6 are turned down onto body surfaces 3 and 4. A slanted surface 7 can be seen in the head region of body surface 1, which projects from the rectangle profile of the container predetermined by the base and onto which a closure element 8 is affixed. Therefore, body surface 1 located beneath closure element 8 has a protuberance, so that this surface projects convexly out of the right-parallelepiped-shaped main body. Opposite (rear) body surface 2 is provided with a corresponding indentation, not shown in more detail, as is described in more detail in the following.

Figure 5:
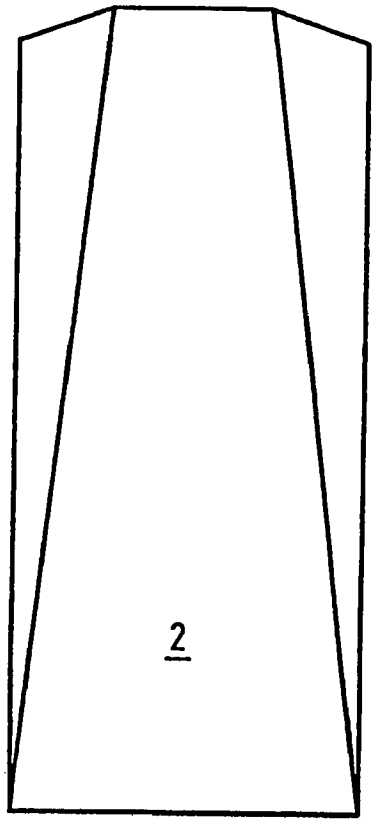
FIG. 5 shows the container from FIG. 1 in a rear view.
Figure 4:
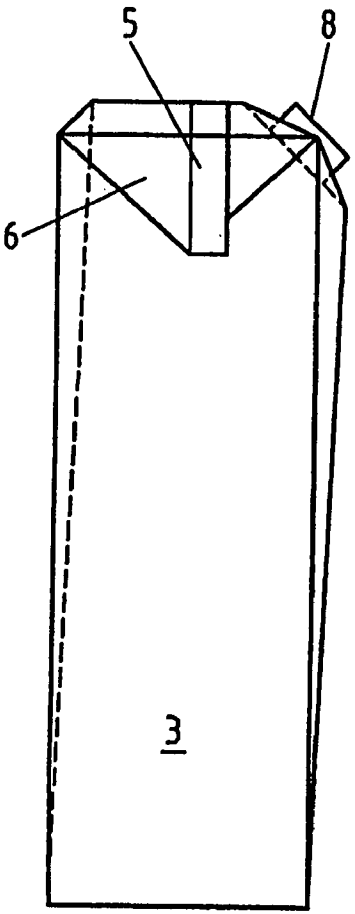
FIG. 4 shows the container from FIG. 1 in a side view.
Figure 3:
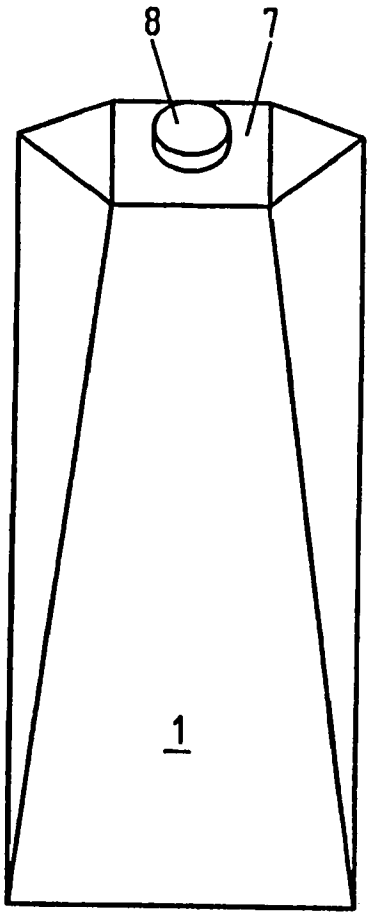
FIG. 3 shows the container from FIG. 1 in a front view.
Figure 6:
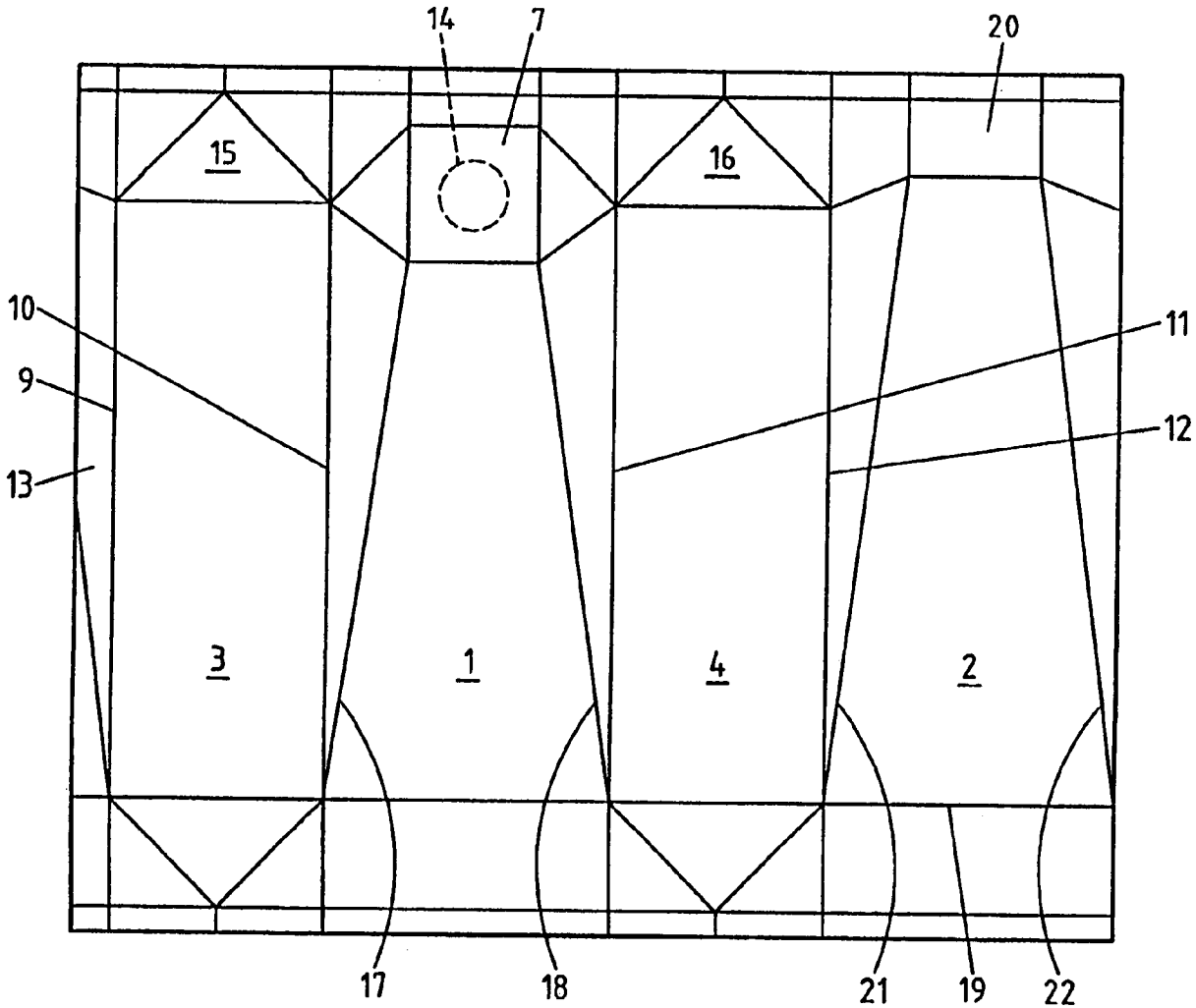
FIG. 6 shows the blank of the container according to the present invention from FIG. 1.
Figure 8:
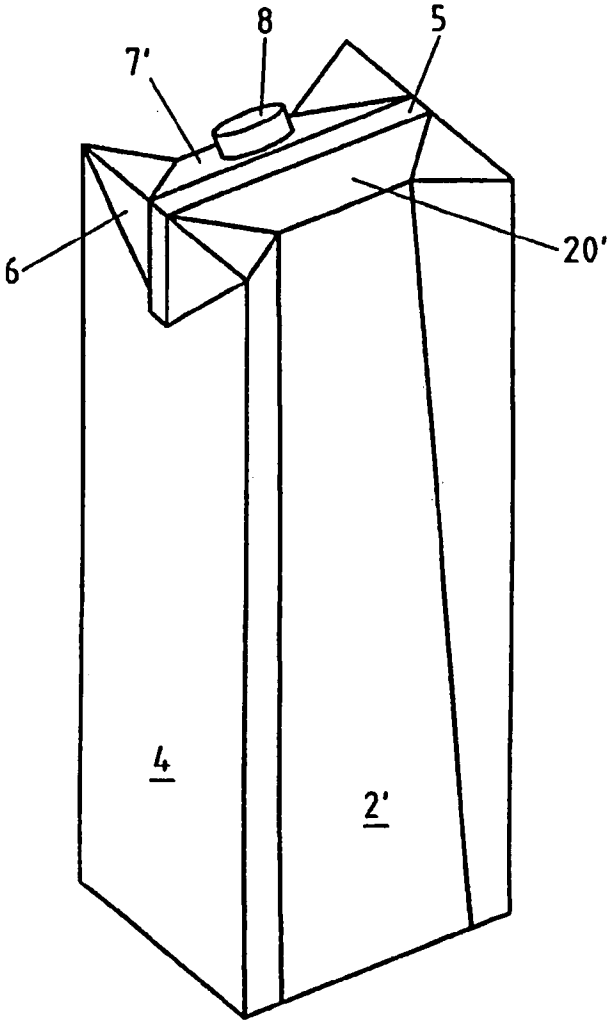
FIG. 8 shows the container from FIG. 7 viewed in perspective from the rear.
Figure 7:
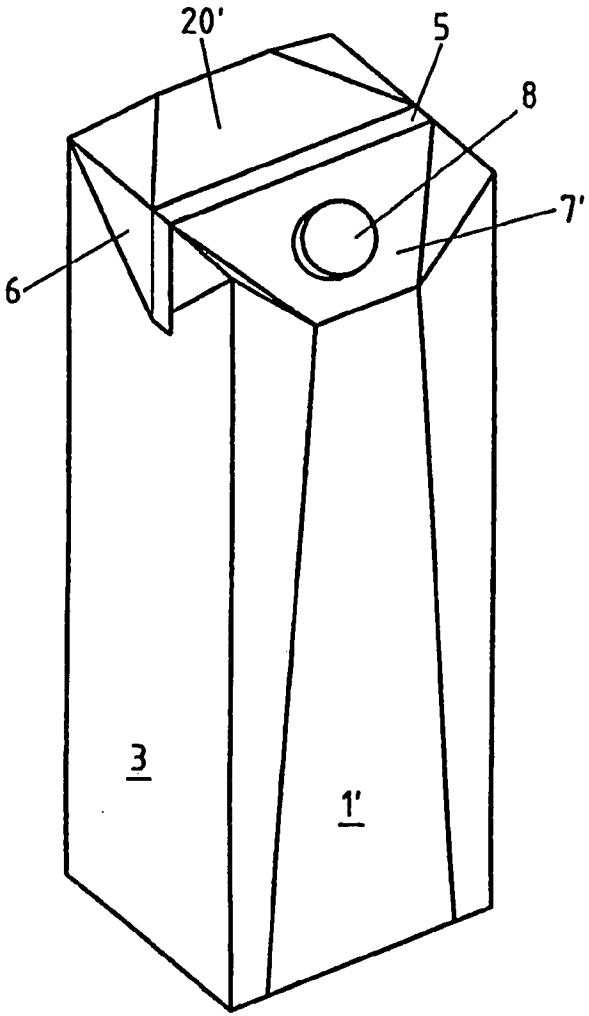
FIG. 7 shows a container according to the present invention in perspective in a second embodiment.
Figure 11:
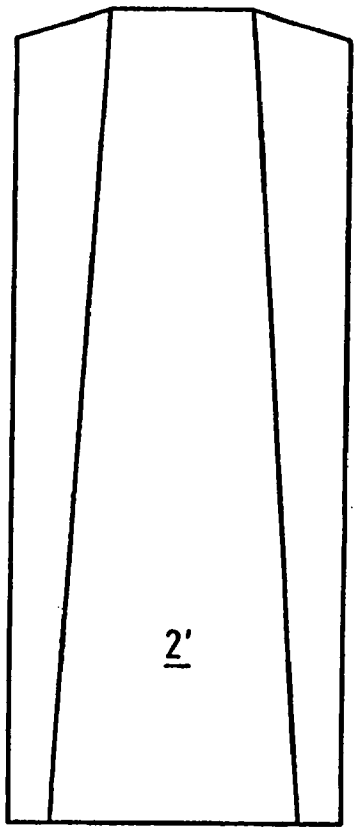
FIG. 11 shows the container from FIG. 7 in a rear view.
Figure 10:
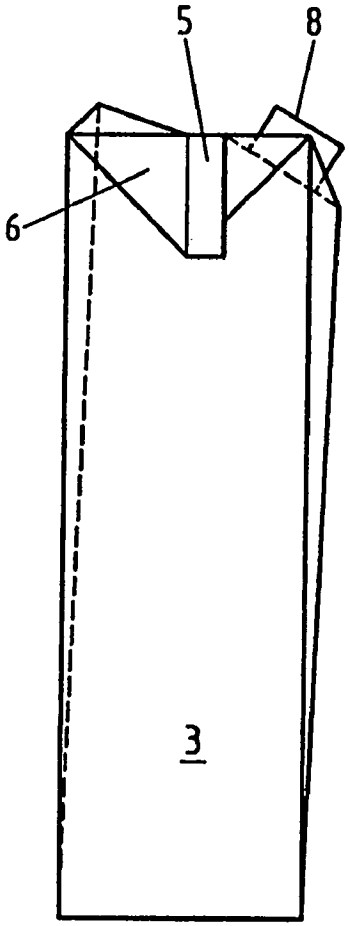
FIG. 10 shows the container from FIG. 7 in a side view.
Figure 9:
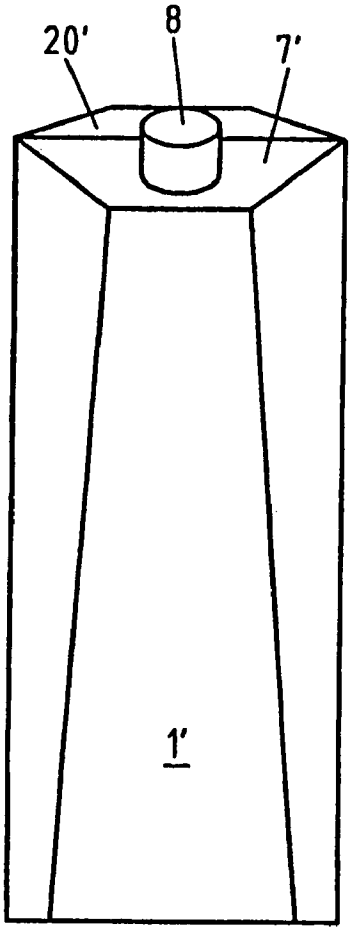
FIG. 9 shows the container from FIG. 7 in a front view.
Figure 12:
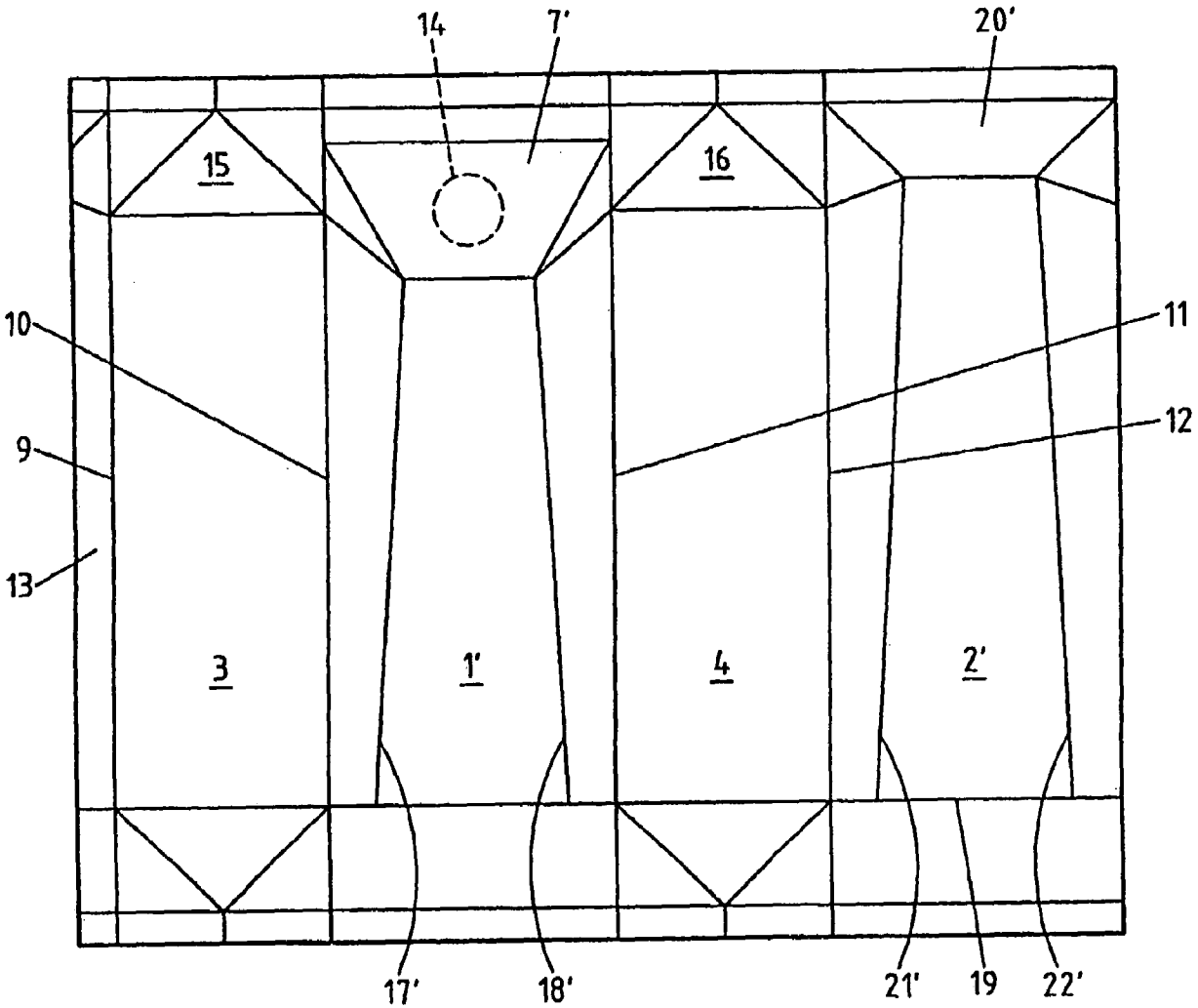
FIG. 12 shows the blank of the container according to the present invention from FIG. 7.
Figure 14:
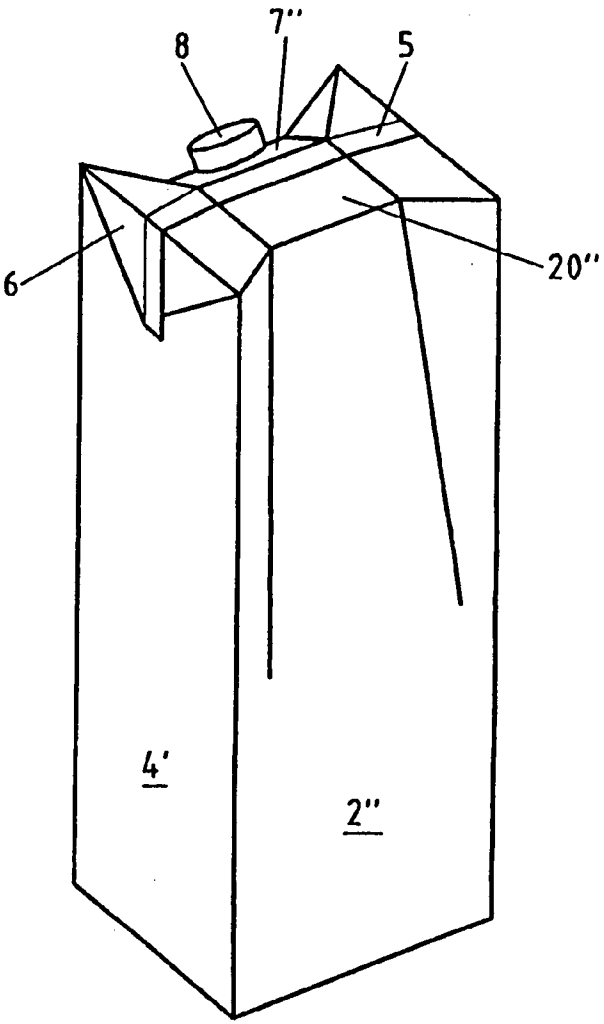
FIG. 14 shows the container from FIG. 13 viewed in perspective from the rear.
Figure 13:
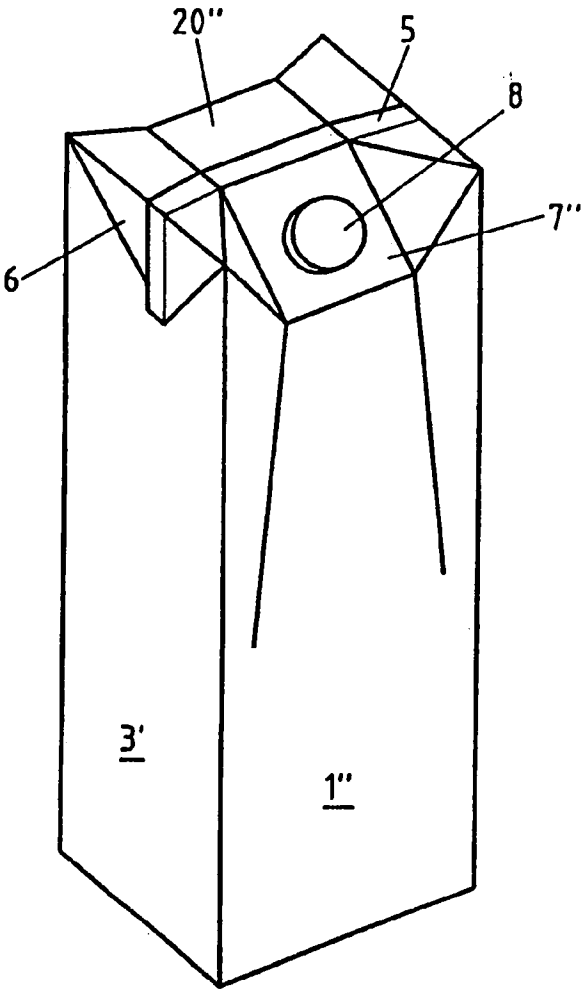
FIG. 13 shows a container according to the present invention in perspective in a further embodiment.
Figure 17:
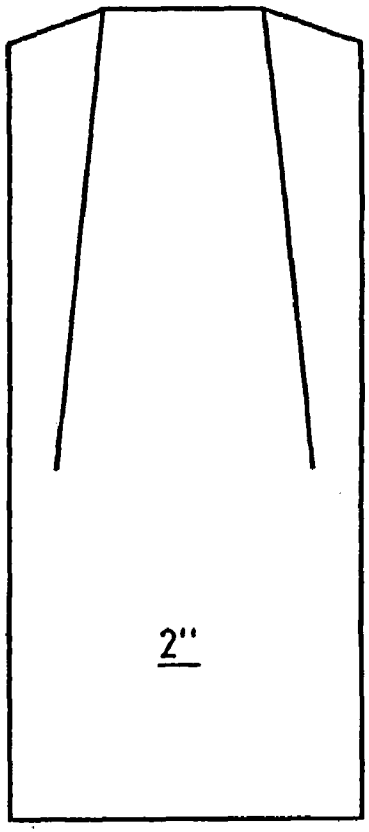
FIG. 17 shows the container from FIG. 13 in a rear view.
Figure 16:
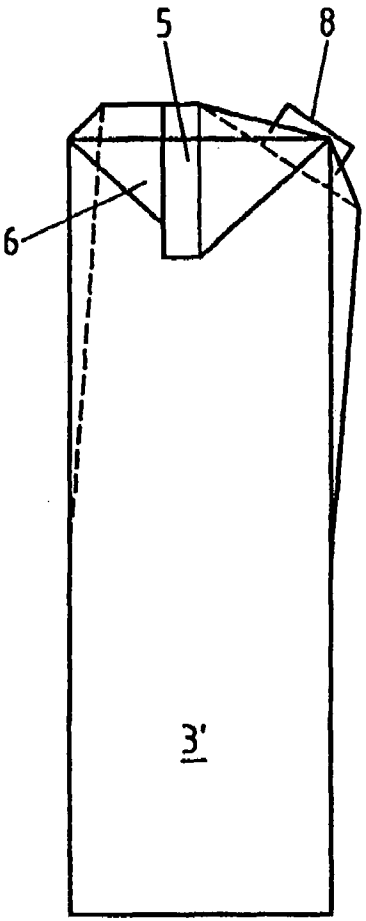
FIG. 16 shows the container from FIG. 13 in a side view.
Figure 15:
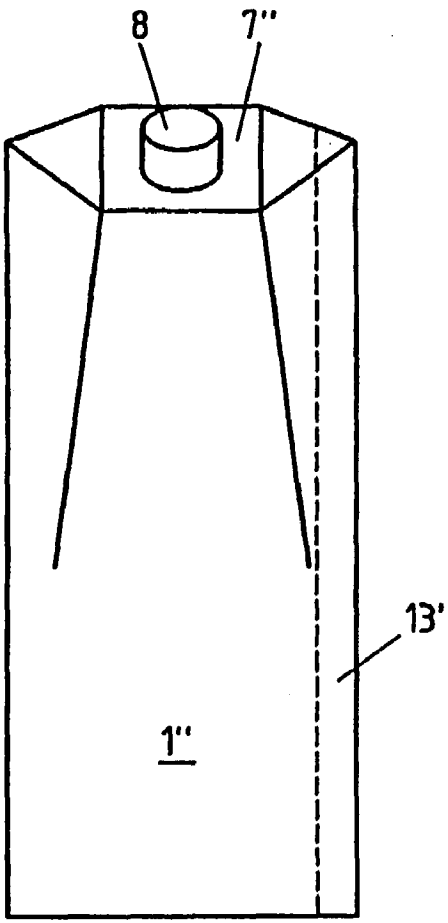
FIG. 15 shows the container from FIG. 13 in a front view.
Figure 18:
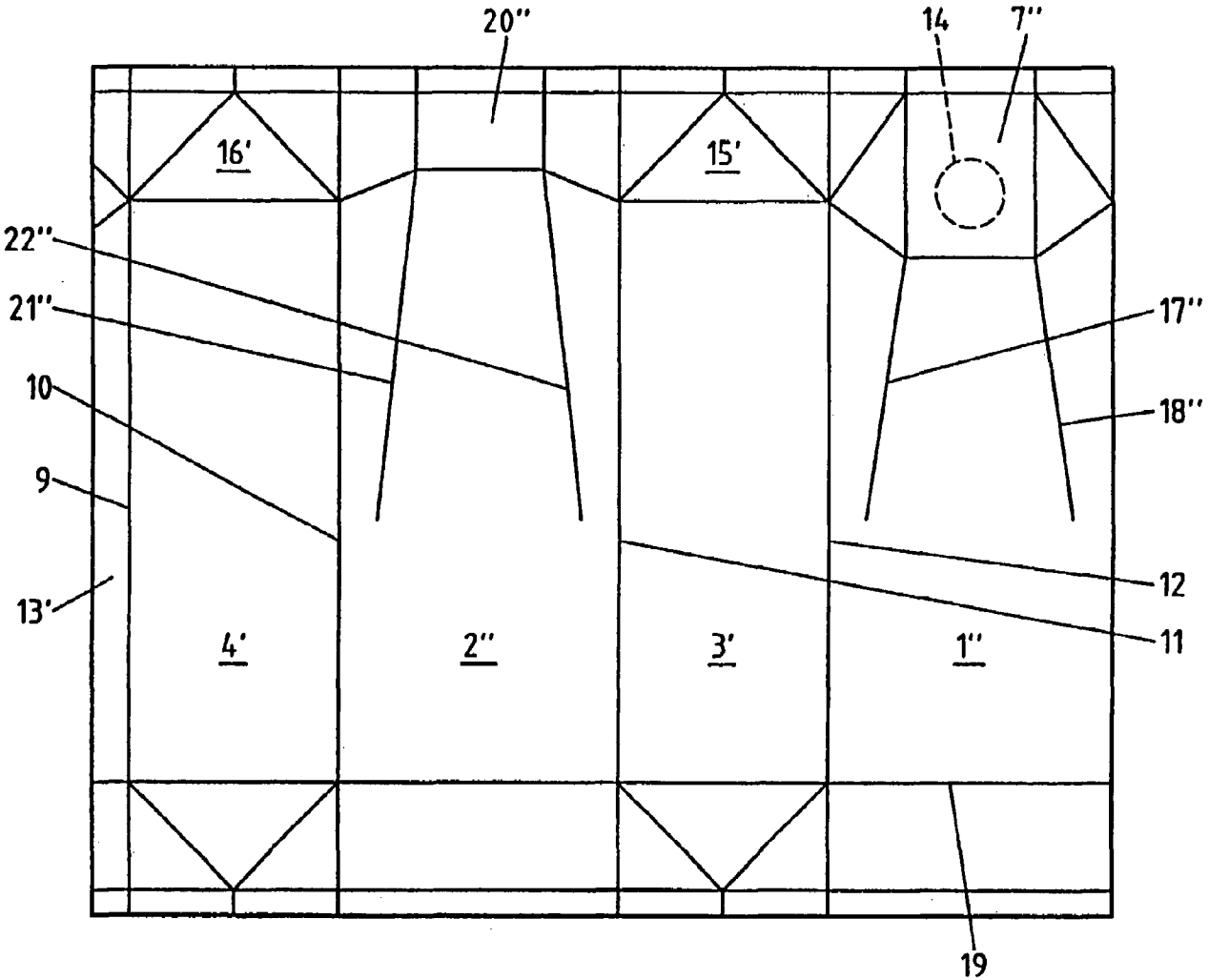
FIG. 18 shows the blank of the container according to the present invention from FIG. 13.

In FIGS. 3 to 5, the container according to the present invention is shown in three different side views. For the sake of simplicity, the container according to the present invention is explained in more detail in the following with reference to the description of its blank. In FIG. 6, the blank of the container according to the present invention is illustrated, which can be made of any expedient material, preferably of the composite material typical for disposable beverage packages. As can be seen in the illustration, the blank comprises a square sheet of the appropriate material. This square is divided by vertical corner lines 9, 10, 11, 12 and the edge lines of the blank into five main fields, later side surfaces 1, 2, 3, and 4, and a longitudinal seam strip 13. In this case, main fields 3 and 4, defined by vertical corner lines 9, 10 and/or 11, 12 and the upper and lower edge of the blank, are identical.

However, main fields 1 and 2 differ in essential features. Main field 1, defined by vertical corner lines 10 and 11 and the upper and lower edge of the sheet, has a centrally located rectangular field 7 (the later slanted surface) in the upper region, which is intended to receive closure element 8. For this purpose, a weakening, for example perforation 14, is provided in the composite material in field 7. Fold lines lead from the corner points of field 7 to the corner points of triangles 15 and 16, which form later package ears 6. Both lower corner points of field 7 are connected via fold lines 17 and 18 with intersection points of field 1 formed with sheet edge fold line 19, and end there in the corners. The position of field 7 and its dimensioning are variable and relate to the space required and/or the height of closure element 8. In order to achieve optimum stacking, it is recommended that the dimensioning and positioning of the previously described surface of field 7 and corresponding surface 20 on rear side wall 2 be implemented so that they lie on the same horizontal plane as the highest point of closure element 8.

Fold lines 21 and 22 are also present in rear main field 2 to stabilize and structure the indented rear face. These run from the lower corner points of face 20 to intersection points of field 2 formed with sheet edge fold line 19, and from there to the corners.

Main fields 3 and 4, as well as the entire lower region of the blank (below sheet edge fold line 19), will not be explained, since these regions correspond to the typical blank of a known right-parallelepiped-shaped composite package.

A further embodiment is described in FIGS. 7 to 12, with the reference numbers used being correspondingly arranged. This embodiment of the container according to the present invention shows a body surface 1', which in the head region of the container passes over into a trapezoidal slanted surface 7', which is intended for the purpose of receiving closure element 8. As can be seen in the blank of this embodiment of the container according to the present invention illustrated in FIG. 12, corresponding surface 20' of rear body surface 2' is also implemented as trapezoidal.

Fold lines 17', 18' and/or 21', 22' running below slanted surface 7' and/or surface 20' now do not run to the container corners, but in this case meet sheet edge fold line 19 outside the container corners, but inside surface 2'. This measure has the advantage that fold lines 21', 22' may be steered out of the region of the double material guide (lengthwise seam 13). Such a design can, of course, also be implemented in the first embodiment shown in FIGS. 1 to 3.

Finally, in FIGS. 13 to 18, a further embodiment of the container according to the present invention is described. In this case, the head region of the container essentially corresponds to that in the first embodiment (FIGS. 1 to 6). However, in this case rib seam 5 is bent over to the other side, so that slanted surface 7" is larger than in the first embodiment. This can be seen particularly well in FIG. 18. In the blank illustrated there, it can be seen that rib seam 13' is now formed not on the back, but on the front of the container according to the present invention, specifically on body surface 1". For this reason, rib seam 5 is also bent over so it points away from body surface 1" and/or slanted surface 7", in order to avoid too strong material bending of the lengthwise seam.

In addition, it can be seen quickly in FIGS. 13 to 18 that fold lines 17", 18" and/or 21", 22" positioned below surfaces 7" and/or 20" do not reach up to sheet edge line 19, but only up to approximately the middle of the container. Such an embodiement is less costly in regard to the folding of the blank and, in spite of this, leads to the advantages according to the present invention.

What is claimed is:

1. A non-gable top reclosable container comprising:

a rectangular base, four lateral wall surfaces extending from said base and being positioned essentially perpendicular to each other, a head region having a slanted surface, a rib seam which seals said head region after said container is filled with a liquid or paste, a closure element positioned on said slanted surface of said head region, said lateral wall surfaces and said head region being configured so that said slanted surface carrying said closure element at least partially projects outwardly from an upwardly projecting rectangular profile of the base, the lateral wall surface below said closure element thereby having a protuberance, and the opposing lateral wall surface partially projecting inwardly of the rectangular profile of the base, thereby forming a corresponding indentation at least in the head region.

2. A container according to claim 1 wherein the rib seam is bent over towards the slanted surface.

3. A container according to claim 1 wherein the rib seam is bent away from the slanted surface.

4. A container according to claim 1 wherein at least one of the protuberance and the indentation tapers uniformly from the head region to the rectangular base.

5. A container according to claim 4 wherein fold lines forming at least one of the protuberance and the indentation extend into lower corners of the container.

6. A container according to claim 4 wherein fold lines forming the protuberance extend up toward a lower front edge of the container and end in a region of corners of the container.

7. A container according to claim 1 wherein at least one of the protuberance and the indentation extends from the head region down to approximately half the container height.

8. A container according to claim 1 wherein said closure element comprises a screw closure.

* * * * *